United States Patent [19]

Takase et al.

[11] Patent Number: 4,613,221

[45] Date of Patent: Sep. 23, 1986

[54] DEVELOPING APPARATUS

[75] Inventors: Haruo Takase; Yoshimitsu Hanai, both of Kanagawa; Ryuzi Otomo, Tokyo, all of Japan

[73] Assignee: Fuji Photo Film Co., Ltd., Kanagawa, Japan

[21] Appl. No.: 711,429

[22] Filed: Mar. 13, 1985

[30] Foreign Application Priority Data

Mar. 13, 1984 [JP] Japan ..... 59-47973
Mar. 13, 1984 [JP] Japan ..... 59-47974
Mar. 13, 1984 [JP] Japan ..... 59-47976

[51] Int. Cl.[4] ..... G03D 3/13

[52] U.S. Cl. ..... 354/321; 354/322; 226/92; 226/170

[58] Field of Search ..... 354/316, 320, 321, 322, 354/338, 339; 226/92, 170, 171, 172, 173; 134/64 P; 352/235

[56] References Cited

U.S. PATENT DOCUMENTS

| | | | |
|---|---|---|---|
| 2,770,179 | 11/1956 | Dye et al. | 134/64 P |
| 3,462,054 | 8/1969 | Foor | 352/235 |
| 3,587,436 | 6/1971 | Nast | 134/64 P |
| 3,712,206 | 1/1973 | Schmidt et al. | 354/338 |
| 4,131,356 | 12/1978 | Schmidt et al. | 354/339 |

*Primary Examiner*—A. A. Mathews
*Attorney, Agent, or Firm*—Sughrue, Mion, Zinn, Macpeak, and Seas

[57] ABSTRACT

One end of a long or continuous film is retained by a leader. The leader is engaged with engagement projections formed on the outer periphery of an endless timing belt stretched between sprocket wheels in order to guide the leader such that the film is conveyed through a treating solution contained in a treating tank. Guide means are disposed in the treating tank such as to oppose the outer periphery of the timing belt, thereby maintaining the engagement between the leader and the timing belt.

33 Claims, 19 Drawing Figures

DEVELOPING APPARATUS

BACKGROUND OF THE INVENTION

1. Field of the Invention

The present invention relates to a developing apparatus equipped with a film conveying mechanism which conveys a film to be developed through various treating tanks.

2. Description of the Prior Art

Development of films, particularly color films, generally includes the steps of development, bleaching, fixing, rinsing and drying. The number of steps required for development of color films is generally large as compared with that required for the development of monochrome films.

For this reason, these days, all the steps required for development of films are automatically carried out by means of a conveyor system. A typical automatic developing apparatus adopting the conveyer system has conventionally been arranged such that a film pulled out of a film cassette by a feed mechanism is passed by a conveyor belt through treating tanks containing the respective treating solutions, such as a developing solution, a bleaching solution, a fixing solution, rinsing water and a stabilizing solution, and is then passed through a dryer before being deposited in a predetermined box.

This type of conventional automatic developing apparatus, however, suffers the following disadvantages: In the developing apparatus, the film is moved through various tanks together with the conveyor belt in such a manner that one end of the film is attached to the belt by a clip. Therefore, a relatively large amount of the treating solution contained in one tank is undesirably carried by the conveyor belt to the subsequent tank, thus causing an increase in the consumption of each treating solution as well as quick contamination of the treating solution in each tank. In the conventional automatic developing apparatus, further, it is necessary to conduct an operation for releasing the film from the clip and depositing the former in the box at the end of the developing process and, therefore, handling of the film is troublesome.

Another type of conventional automatic developing apparatus has been designed wherein a leader having a plurality of bores is fed through a conveyor passage in which a multiplicity of sprockets are disposed, while leading the film. In this type of automatic developing apparatus, however, a multiplicity of sprockets are unfavorably required, and it is troublesome to effect adjustment such that the distance between the adjacent sprockets is accurately maintained.

SUMMARY OF THE INVENTION

In view of the above-described facts, it is a primary object of the present invention to provide a developing apparatus equipped with a film conveying mechanism in which the amount of treating solution undesirably carried out is reduced and which has a simplified structure and facilitates the handling of the film.

To this end, according to the invention, there is provided a developing apparatus equipped with a film conveying mechanism in which an endless timing belt is employed which has at least one portion thereof immersed in each treating tank of the developing apparatus and is engaged with sprocket wheels such as to be driven and guided thereby. The timing belt has on its outer periphery engagement projections formed at predetermined spacings which are engaged with engagement bores formed in a leader which has one end of a film attached thereto, in order to transmit the driving force of the timing belt to the leader, thereby feeding the film into each treating tank while guiding the film by the leader. In the film conveying mechanism, further, the engagement between the leader and the timing belt is ensured by guide means which are disposed in opposing relation to the outer periphery of the timing belt, thereby allowing the leader to reliably receive the driving force of the timing belt so as to move properly.

By virtue of this arrangement, the leader is reliably transferred to the treating tanks in order, and the need to retain the film by a clip is eliminated, thus facilitating the handling of the film.

BRIEF DESCRIPTION OF THE DRAWINGS

The above and other objects, features and advantages of the present invention will become more apparent from the following description of the preferred embodiment thereof, taken in conjunction with the accompanying drawings, in which like reference numerals denote like elements, and in which.

DESCRIPTION OF THE PREFERRED EMBODIMENT

Figure 1:
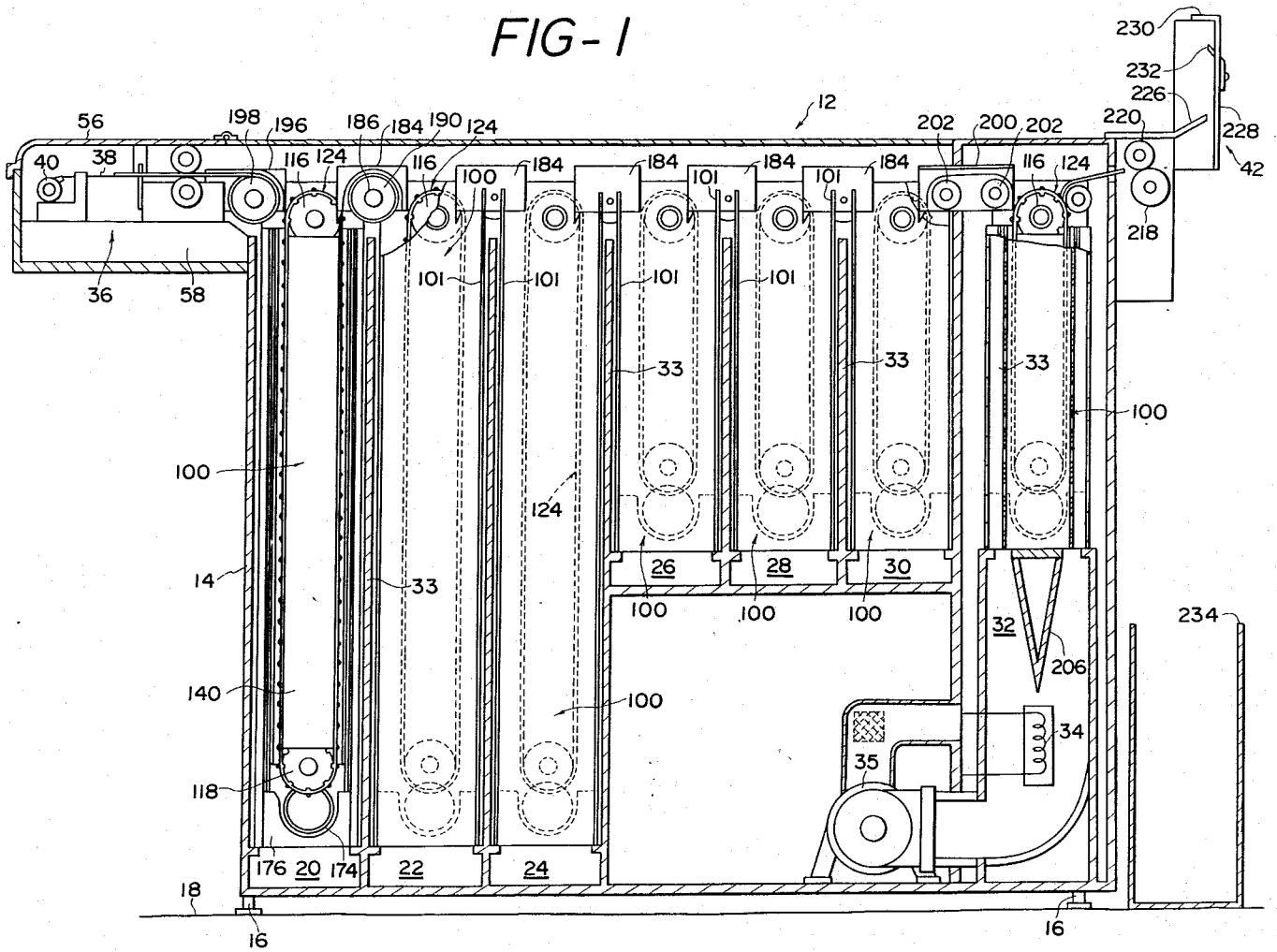
FIG. 1 is a sectional side elevational view of one embodiment of the developing apparatus equipped with a film conveying mechanism in accordance with the present invention.

FIG. 1 is a sectional side elevational view of a developing apparatus 12 according to the present invention is applied. The developing apparatus 12 has its outside constituted by a frame 14 in such a manner that all the external light is shut off. The lower part of the frame 14 is supported on a floor 18 by a plurality of support legs 16.

The frame 14 is provided therein with a plurality of vertically extending treating tanks 20, 22, 24, 26, 28, 30 and 32 in series. The adjacent treating tanks are partitioned from each other by vertical walls 33. The treating tank 20 is filled with a developing solution; the treating tank 22 with a bleaching solution; the treating tank 24 with a fixing solution; the treating tanks 26, 28 with rinsing water; and the treating tank 30 with a stabilizing solution. The treating tank 32, which serves as a drying chamber, has a heater 34 and a fan 35 which are disposed in the lower part thereof so that warm air is supplied to the upper part of the tank 32.

A film feed device 36 is disposed on one of the sides of the treating tank 20 which is closer to the inlet side (the left-hand side as viewed in FIG. 1) of the developing apparatus 12. The film feed device 36 is arranged such that films 38 which are to be developed are pulled out from associated film cassettes 40 and are fed to the treating tank 20. On the other hand, a film accumulating device 42 is disposed on one of the sides of the treating tank 32, namely, the side of the developing apparatus 12 which is opposite to the side thereof on which the film feed device 36 is disposed. The film accumulating device 42 is arranged such as to accumulate the films 38 which have passed through the developing process.

Figure 2:
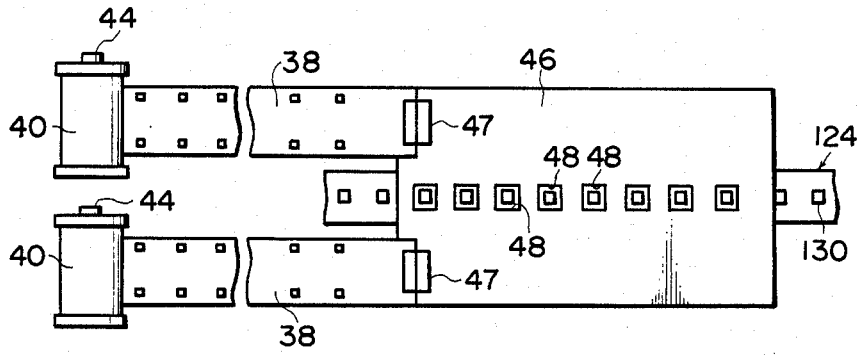
FIG. 2 is a plan view showing how a film is attached to a leader employed in the embodiment.

The films 38 are, as shown in FIG. 2, respectively housed in the film cassettes 40, being wound on respective spools 44. According to this embodiment, the leading ends of two films 38 unwound from the associated spools 44 are secured to a single leader 46 by strips of adhesive tape 47 or other similar bonding means. The leader 46 is constituted by a flexible synthetic resin sheet which is slightly higher in rigidity than the films 38. The leader 46 has square bores 48 serving as engagement bores which are longitudinally formed in a row in the center thereof at proper spacings.

The film feed device 36 will be explained hereinunder in more detail with reference to FIGS. 3 and 4.

The film feed device 36 is installed in the upper part of the frame 14 on the inlet side (the left-hand side as viewed in FIG. 1) of the developing apparatus 12. The upper side of the film feed device 36 is covered by an openable cover 56. A base plate 58 is disposed in the frame 14 such as to extend in the conveying direction of the films 38. A pair of film holders 60 having an angled cross-section are installed in parallel on the base plate 58. The holders 60 are adapted to be slidable on rails 62 laid in the film conveying direction. The holders 60 are normally biased by compression coil springs 64 toward the inlet (the left-hand side as viewed in FIG. 3).

In operation, with the leading ends of two films 38 connected to the leader 46, the film cassettes 40 are mounted on the respective holders 60 and fixed thereto (the fixing structure is not shown), and the leader 46 is inserted into the area between conveyor rollers 66, 67, whereby the films 38 are simultaneously conveyed in the direction of the arrow A. The upper conveyor roller 66 is a movable roller which is rotatably supported on the cover 56 such that, when the cover 56 is opened, the conveyor roller 66 is separated from the other roller 67.

Cutters 68 are installed between the holder 60 and the conveyor roller 66. Each cutter 68 has a sharp or thin edge and is supported at its proximal end by a support 72 through a pin 70 in the manner shown in FIG. 4. Further, a pin 74 is provided projecting from the outer surface of the support 72, and a torsion coil spring 76 is provided between the cutter 68 and the pin 74 in order to bias the cutter 68 such that the distal end thereof is normally at a lower position as viewed in FIG. 4.

The lower surface of the distal end of each cutter 68 is contacted by an actuating pin 80 projecting from a slot 78 formed in the support 72. The actuating pin 80 is adapted to be vertically moved within the slot 78 by a solenoid 82 (see FIG. 3) which is installed inside the support 72. Accordingly, when the actuating pin 80 is moved upwardly, the corresponding cutter 68 is pivoted against the biasing force of the torsion coil spring 76 in such a manner that the distal end thereof is moved in the direction (upwardly as viewed in FIG. 4) in which the film 38 can be cut. For explanatory convenience, the two cutters 68 in FIG. 4 are shown in different positions from each other: the left cutter 68 is in the state prior to cutting; the right cutter 68 is in the state after cutting. If two films have the same length, however, both the cutters 68 operate simultaneously.

Above each cutter 68, a guide 84 is installed for receiving and guiding the cutter 68. The guide 84 has its upper end secured to the inner surface of the cover 56. The guide 84 further has a cutter receiving guide groove 86 formed in the lower part thereof. A portion of the guide groove 86 near the opening thereof is gradually enlarged such as to define a divergent portion 86A, whereby the cutter 68 in an operative state can smoothly fit into the guide groove 86.

Figure 4:
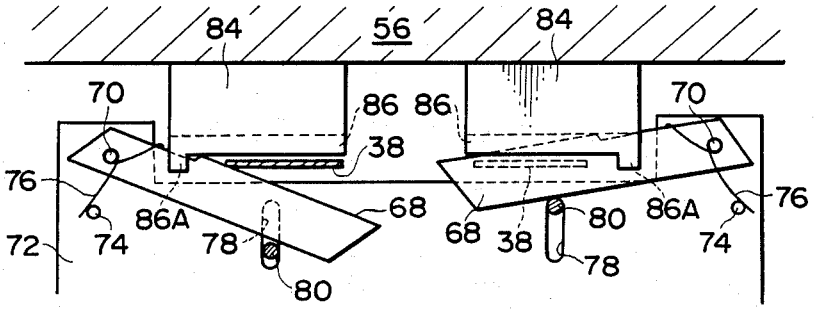
FIG. 4 is a sectional view taken along the line IV—IV of FIG. 3.

Further, as will be understood from an examination of the cutter 68 on the left-hand side as viewed in FIG. 4, a portion of the cutter 68 in the state before cutting is located within the guide groove 86. By virtue of these arrangements, even if the cutter 68 has a thin edge, it can reliably fit into the guide groove 86 when cutting the film, whereby it is possible to prevent any mistake in cutting.

Further, since the cutter 68 may have a thin edge, it is possible to employ an ordinary marketed cutter. It is, therefore, possible to remarkably reduce the costs of the cutter mechanism.

Figure 3:
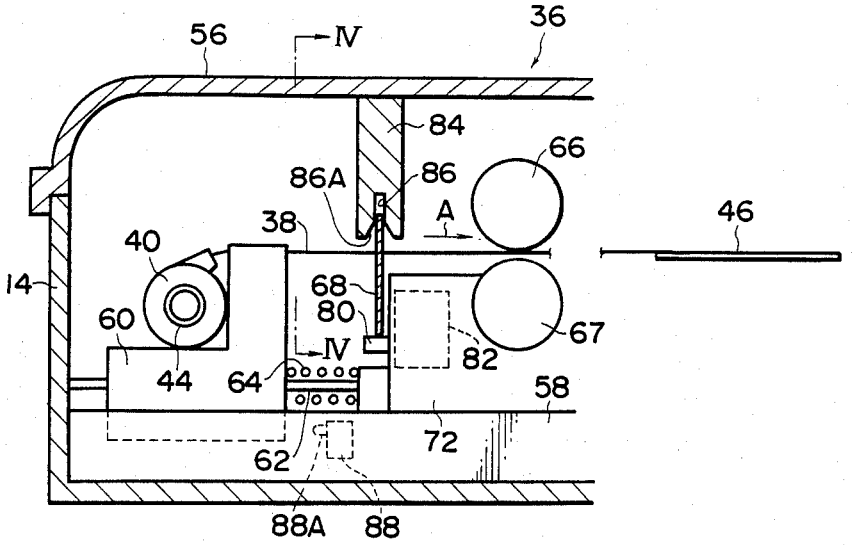
FIG. 3 is an enlarged view of a portion of the embodiment, which particularly shows a film feed device employed in the embodiment.

The base plate 58 has, as shown in FIG. 3, limit switches 88 disposed thereon in such a manner that their contactors 88A oppose the front end surfaces of the respective holders 60. The limit switches 88 are electrically connected to the solenoids 82. When each film 38 has been totally pulled out of the associated film cassette 40, the force applied in order to pull out the film 38 is transmitted to both the film cassettes 40 and the holders 60. Thereupon, the holders 60 themselves are moved in the film feeding direction against the biasing force of the compression coil springs 64.

Accordingly, when the films 38 have been completely pulled out of the film cassettes 40, the holders 60 are advanced to press the contactors 88A of the limit switches 88, whereby cutter actuating signals are delivered to the solenoids 82. More specifically, when the limit switches 88 detect the fact that the films 38 have been completely pulled out of the film cassettes 40, the cutters 68 are actuated such as to cut the trailing ends of the films 38 from the film cassettes 40. The films 38 after being cut off are fed to the corresponding developing line, together with the leader 46.

In each treating tank, a film conveyor unit 100 is mounted. The film conveyor unit 100 is arranged such that the film 38 first moves downwardly such as to be dipped in the treating solution contained in the corresponding tank and then turns upwardly at the bottom part of the tank such as to be conveyed out of the tank.

The film conveyor unit 100 will be described hereinunder in detail with reference to FIGS. 5 to 8.

In the film conveyor unit 100, a pair of side plates 102 are disposed in opposing relation to each other, each side plate 102 having a bent portion 101 formed at both sides thereof. Between these side plates 102 are stretched a plurality of support rods 104, and both ends of each support rod 104 are secured to the corresponding side plates 102 by screws 106, whereby the distance between the side plates 102 is set.

Further, rotating shafts 108, 110 are rotatably supported through bearings 112, 114, respectively, near both ends of the side plates 102, that is, near the upper and lower ends thereof in an assembled state. Sprocket wheels 116, 118 which act as belt engaging wheels are secured to the respective central portions of the rotating shafts 108, 110 such as to rotate together with the shafts 108, 110. One of the ends of the rotating shaft 108 projects from the side plate 102, and a sprocket wheel 120 is secured to the distal portion of the projecting end of the rotating shaft 108. A chain 122 is engaged with the sprocket wheel 120 and is rotated by the driving force of a motor, not shown, thereby enabling the rotating shaft 108 and the sprocket wheel 116 to rotate.

Figure 10:
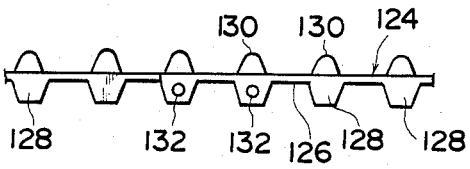
FIG. 10 is a side elevational view showing the ends of the timing belt in a connected state.

A timing belt 124, also shown in FIG. 10 in detail, is engaged with both the sprocket wheels 116, 118. The timing belt 124 is integrally molded from a synthetic resin. The timing belt 124 has a belt base 126 which has a small width and a small thickness. On one of the sides of the belt base 126 are formed a plurality of trapezoidal projections 128 serving as timing projections at equal spacings. On the other side of the belt base 126 are formed engagement projections 130 at equal spacings and at positions corresponding to the trapezoidal projections 128, the engagement projections 130 having a smaller width than that of the trapezoidal projections 128. The engagement projections 130 are engaged with the square bores 48 in the leader 46, whereby the leader 46 is driven along the timing belt 124.

The timing belt 124 has a predetermined length. Both ends thereof are connected together by a pair of connecting pins 132 in the manner shown in FIG. 10. This connecting structure will be explained in more detail. One end 124A of the timing belt 124 is formed by cutting both widthwise edges of the belt base 126 over a distance corresponding to the longitudinal length of a portion of the timing belt 124 which includes two or more engagement projections 130. The other end 124B of the timing belt 124 has in its widthwise center a rectangular notch 134 into which the end 124A is inserted and fitted. Thus, the ends 124A and 124B in combination constitute a connection.

The trapezoidal projections 128 formed at the end 124A and those at the end 124B have through-holes 136 and 138 respectively which are formed in the widthwise direction of the belt base 126 and which are to be located coaxially with each other when both the ends 124A, 124B are connected together. In consequence, when the end 124A is inserted into the notch 134 and the connecting pins 132 which act as connecting means are respectively inserted and secured in the through-holes 136, 138 by press fitting or other similar means, the timing belt 124 is connected at both its ends, thereby obtaining a looped timing belt 124 such as that shown in FIG. 8. Thus, it is possible to stretch the timing belt 124 between the sprocket wheels 116, 118 in such a manner that it can be rotated.

It is to be noted that a plurality of timing belts 124 can be connected together such as to form a single long loop in a manner similar to the above-described. For example, among the treating tanks shown in FIG. 1, the timing belt 124 in each of the treating tanks 20, 22, 24 may be constituted by seven belts which are continuously connected, and the timing belt 124 in each of the treating tanks 26, 28, 30, 32 may be constituted by four continuously connected belts.

In particular, according to this embodiment, the connecting portions at both ends of the timing belt 124 are connected together in such a manner that the connecting portions overlap each other over a distance corresponding to the longitudinal length of a portion of the timing belt 124 which includes two trapezoidal projections 128. For this reason, when the connection is curved at the respective outer peripheries of the sprocket wheels 116, 118, no acute bend is formed. The connection is, therefore, able to draw a smooth curve in a manner similar to that of an intermediate portion of the timing belt 124.

The connecting portions at both ends of the timing belt 124 may overlap each other over a distance corresponding to the longitudinal length of a portion of the belt 124 which includes three or more trapezoidal projections 128 rather than two as in the case of this embodiment.

Between the side plates 102, a support plate 140 is disposed extending between the sprocket wheels 116, 118 such as to oppose the inner peripheral surface of the timing belt 124. The support plate 140 is supported by the side plates 102 through the support rods 104 which are received through the support plate 140 at intermediate portions thereof, respectively.

The support plate 140 further has circular notches 142 which are respectively formed at both longitudinal ends thereof such as to partially receive the sprocket wheels 116, 118, respectively. In addition, a U-shaped groove 144 is formed on each of the side surfaces of the support plate 140 such as to extend over the whole longitudinal length of the side surface. This U-shaped groove 144 houses the trapezoidal projections 128 formed on the timing belt 124 in order to guide the timing belt 124 such that it is prevented from moving in the widthwise direction.

On the other hand, a pair of guide bars 146 serving as guide means are provided such as to interpose the timing belt 124 therebetween. More specifically, each guide bar 146 is disposed on the side of the timing belt 124 which is remote from the support plate 140 such as to oppose the outer peripheral straight portion of the timing belt 124. The guide bars 146 are respectively secured to a pair of cover plates 148 which are stretched between the side plates 102.

Each guide bar 146 has a U-shaped groove 150 formed in the surface thereof which opposes the timing belt 122. The U-shaped groove 150 has a width slightly larger than the width of the engagement projections 130 formed on the timing belt 124, thus serving as a passage for the engagement projections 130 when the timing belt 124 is moved.

Further, the guide bar 146 is disposed such as to form a slight gap between the same and the surface of the belt base 126. More specifically, the gap is a space for allowing passage of the leader 46 when being pulled by the timing belt 124. Thus, the guide bar 146 serves to retain the leader 46 between the same and the timing belt 124 and to prevent disengagement between the engagement projections 130 and the square bores 52.

Figure 5:
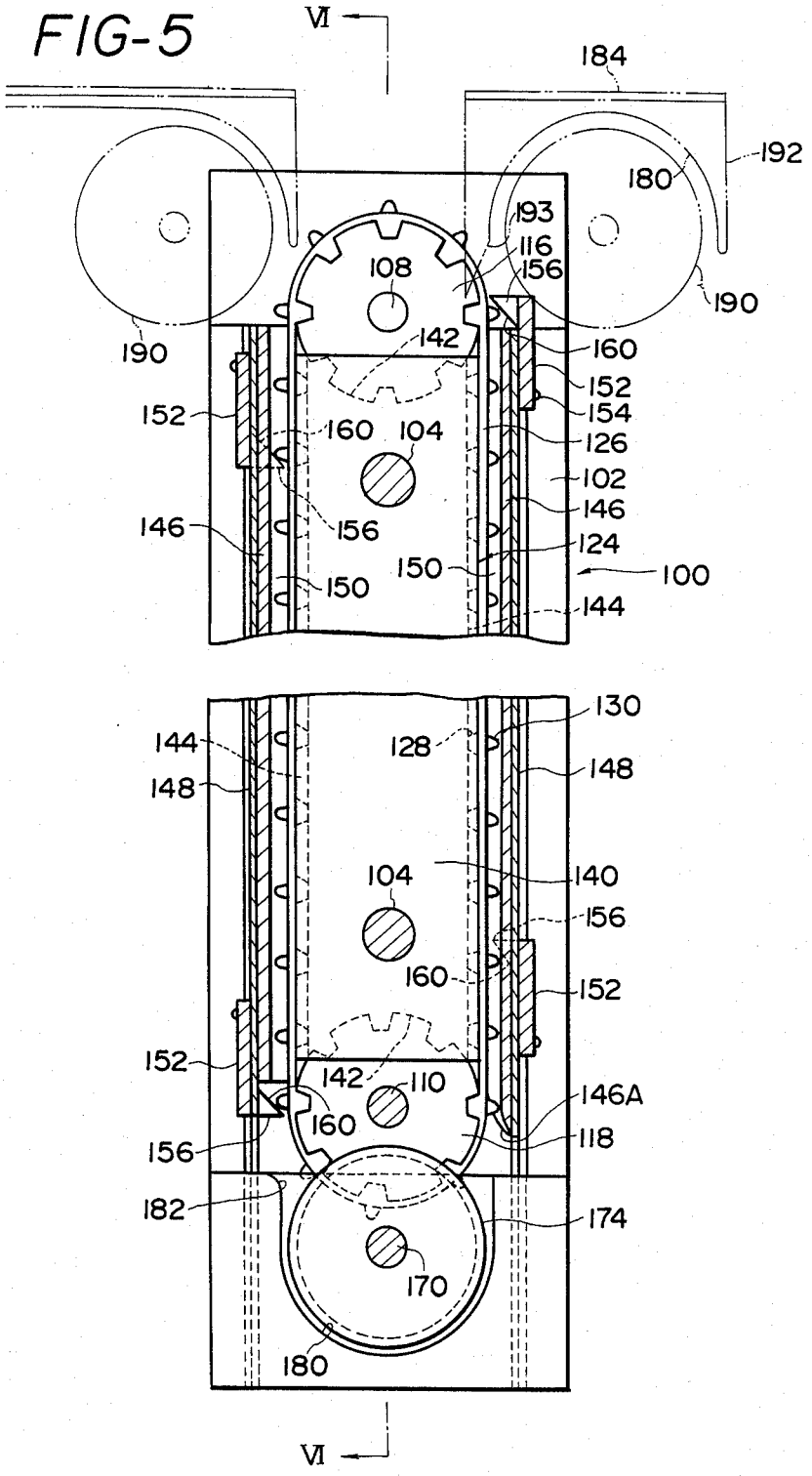
FIG. 5 is an enlarged sectional view of a film conveyor unit employed in the embodiment, which corresponds to a sectional view taken along the line V—V of FIG. 7.
Figure 6:
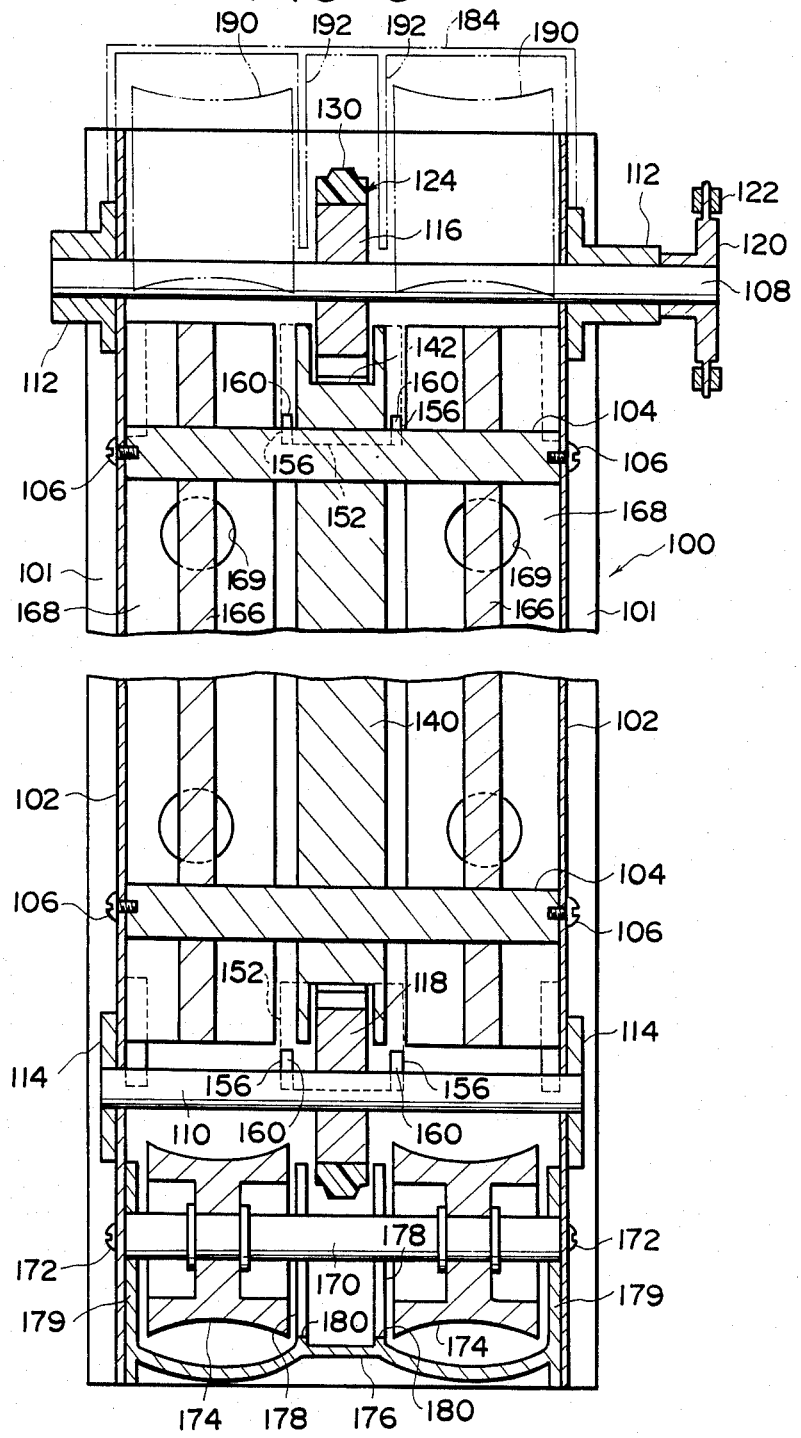
FIG. 6 is a sectional view taken along the line VI—VI of FIG. 5.
Figure 8:
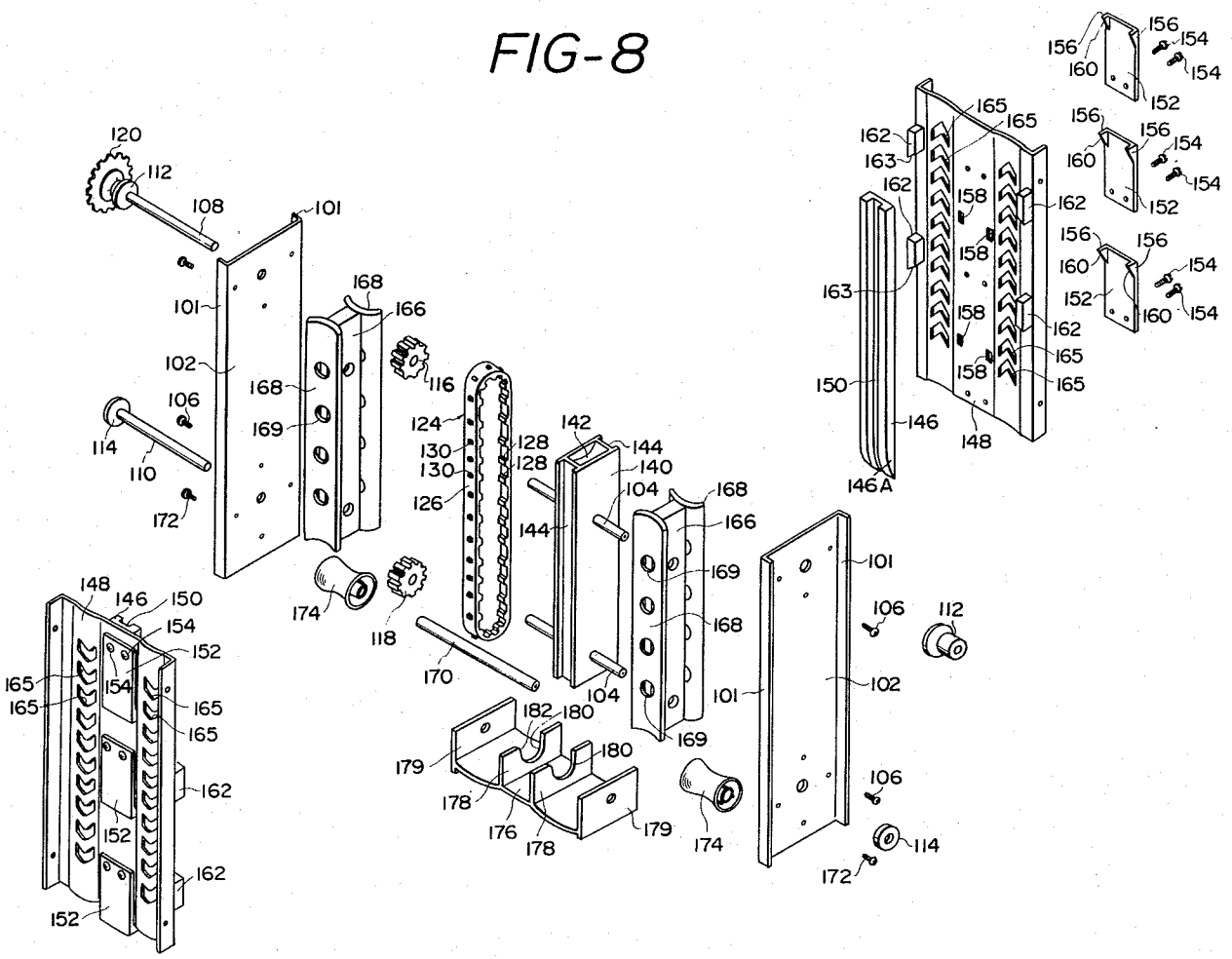
FIG. 8 is an exploded perspective view of the film conveyor unit.
Figure 9:
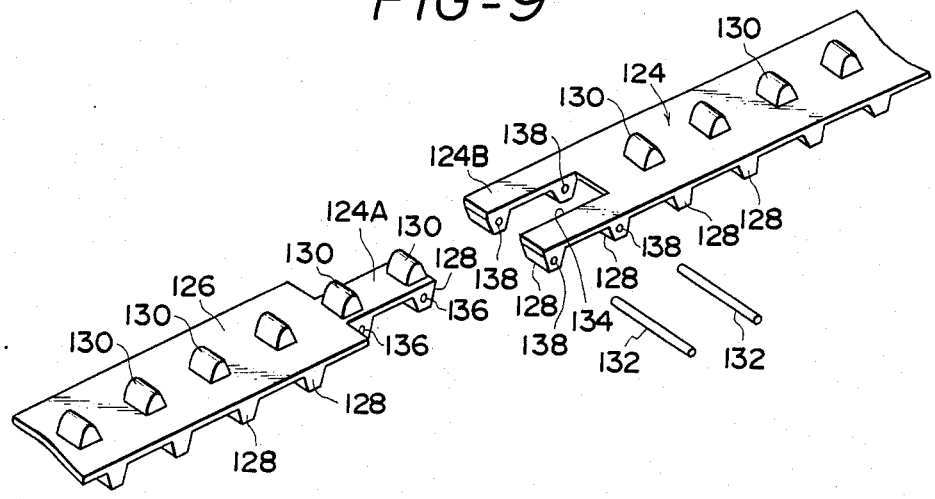
FIG. 9 is an exploded perspective view showing how both ends of a timing belt employed in the embodiment are connected together.

As shown in FIGS. 5 and 8, one of the guide bars 146 has its lower end gradually decreased in wall thickness such as to form a circular guide portion 146A in order to smoothly guide the leader 46 into the area between the guide bar 146 and the timing belt 124 at the portion of the timing belt 124 at which it is changed over from a curved state to a straight state.

Three flexible plates 152 serving as a film meandering preventing mechanism are secured in a vertical row to the outside of each cover plate 148, that is, on the side thereof which is remote from the timing belt 124. Each flexible plate 152 is constituted by a thin-walled plate made of a synthetic resin, as shown in detail in FIG. 8. The flexible plate 152 is secured at one end thereof to the corresponding cover plate 148 by screws 154. The screws 154 are employed to secure the guide bar 146 to the cover plate 148 simultaneously with the fixing of the flexible plate 152.

Figure 7:
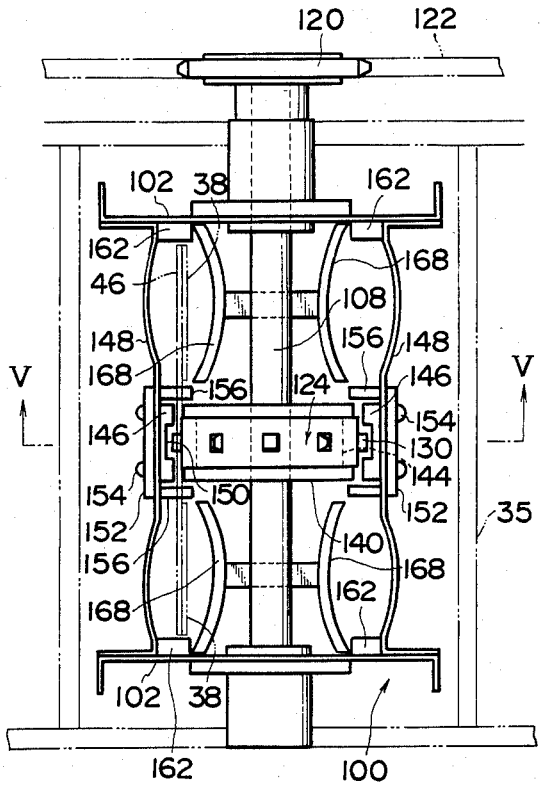
FIG. 7 is a plan view of the film conveyor unit shown in FIG. 5.

Each flexible plate 152 is provided at the other end thereof with a pair of triangular meandering preventing pawls 156 which are integrally molded with the flexible plate 152. These pawls 156 project toward the timing belt 124 in the following manner: One pair of the pawls 156 extend beyond the upper end of one of the cover plates 148; another pair of pawls 156 extend beyond the lower end of the other cover plate 148; and the other pawls 156 respectively pass through rectangular through-holes 158 formed in the cover plates 148, such that the pawls 156 project toward the timing belt 124. The pawls 156 project such as to oppose one of the side edges of the film 38 being conveyed, as shown in FIG. 7, thus serving as limiting means for preventing the moving film 38 from meandering.

Each pawl 156 is disposed such that its slanting surface 160 is inclined with respect to the moving direction of the leader 46 which is fed by the timing belt 124, whereby, when the leader 46 being moved abuts against the slanting surfaces 160 and bends the flexible plate 152, the pawls 156 are pushed out of the moving locus of the leader 46. Accordingly, as it moves, the leader 46 expels the pawls 156 from its moving locus, and, when the leader 46 has passed over, the pawls 156 are allowed to project again from the inner surface of the associated cover plate 148, whereby it is possible to properly guide the side edge of the film 38 as it is pulled by the leader 46. In consequence, even when a plurality of films 38 are guided by the leader 46 as in the case of FIG. 2, it is possible to make the pawls 156 correspond to respective side edges of the films 38.

Further, limiting blocks 162 are secured to portions of each cover plate 148 in the vicinity of both side edges thereof such as to correspond to the flexible plates 152 secured to the cover plate 148. Each limiting block 162 faces the other side edge of the film 38 being moved. Thus, the limiting blocks 162 also serve to prevent meandering of the film 38. Each limiting block 162 has a slanting surface 163 which is formed such as to face the leader 46 being advanced in order to allow the film 38 to be smoothly guided into the area between the limiting block 162 and the corresponding flexible plate 152.

It is to be noted that each cover plate 148 is formed with a plurality of through-holes 165 which serve to allow the treating solution concerned to circulate. Each through-hole 165 is formed in the shape of a 'V' the convergent angle of which points in the advancing direction of the film 38, whereby the film 38 is prevented from contacting the through-holes 165 which would undesirably obstruct the movement of the film 38 if such contact occurred.

Support brackets 166 are respectively secured to the support rods 104 which project from both sides of the support plate 140 disposed inside the timing belt 124. Limiting plates 168 each having a circular cross-section are respectively secured to both sides of each support bracket 166. These limiting plates 168 prevent the films 38 being moved from bending unnecessarily in a corrugated manner. Each limiting plate 168 has a plurality of circular bores 169 so as to promote the circulation of the treating solution concerned.

Between the side plates 102, a support shaft 170 is stretched below the sprocket wheel 118 and in parallel to the rotating shaft 110. The support shaft 170 is secured to the side plates 102 by screws 172. A pair of rollers 174 for turning the leader 46 are rotatably mounted on the support shaft 170.

These rollers 174 have a circular cross-section. More specifically, the outside diameter of each roller 174 is smallest at the axial center thereof and is gradually increased toward both axial ends thereof.

Moreover, a bracket 176 for turning the leader 46 is stretched between the side plates 102 such as to correspond to these rollers 174. Two pairs of vertical walls 178, 179 project from the bracket 176 such that the walls 178, 179 respectively correspond to both axial ends of each roller 174. Each vertical wall 178 is, as shown in detail in FIG. 5, formed with a circular guide portion 180 having an inside diameter slightly larger than the outside diameter of the roller 174. The circular guide portions 180 are open toward the sprocket wheel 118. Thus, the space defined between the guide portions 180 and the rollers 174 forms a U-shaped leader turning guide means. One of the ends of this U-shaped leader turning guide means is disposed on the extension of one of the straight portions of the timing belt 124 such as to form a leader inlet; the other end is disposed on the extension of the other straight portion of the timing belt 124 such as to form a leader outlet.

Accordingly, the leader 46 downwardly guided by the engagement with the engagement projections 130 of the timing belt 124 is released from the retainment by one of the guide bars 146 and the timing belt 124 at its turning position at which it is engaged with the sprocket wheel 118. Accordingly, the leader 46 advances straight downwardly independently of the bending of the timing belt 124 for effecting turning and enters the turning area defined between the circular guide portions 180 and the rollers 174. The leader 46 having entered the turning area makes a turn around the rollers 174 along the guide portions 180 and then re-engages the engagement projections 130 of the timing belt 124 turned by the sprocket wheel 118 such as to be moved upwardly. The leader 46 is smoothly engaged with the engagement projections 130 of the timing belt 124 by virtue of the circular guide portions 146 of the guide bar 146 whereby it can be moved upwardly.

Thus, it is possible to cope with an increase in the pitch of the engagement projections 130 at the position of the timing belt 124 at which it is turned by the sprocket wheel 118. This point will be explained hereinunder in more detail. The timing belt 124 is designed such that a plurality of trapezoidal projections 128 are accurately meshed with the sprocket wheels 116, 118. Therefore, at the straight portions of the timing belt 124, the pitch between a plurality of trapezoidal projections 128 is equal to the pitch between a plurality of engagement projections 130. At the bent portions of the belt 124, however, the pitch between the engagement projections 130 becomes larger than the pitch between the trapezoidal projections 128 by an amount corresponding to the wall thickness of the belt base 126, which fact makes it impossible for the square bores 48 in the leader 46 to properly engage the engagement projections 130. In order to cope with such dimensional change, according to this embodiment, the leader 46 is disengaged from the timing belt 124 at the bent portion of the belt 124 and is re-engaged with the belt 124 after making a turn.

It is to be noted that each circular guide portion 180 has an introducing circular portion 182 formed at its inlet portion such as to make it possible for the leader 46 to easily enter the turning area between each guide portion 180 and the corresponding roller 174.

Figure 11:
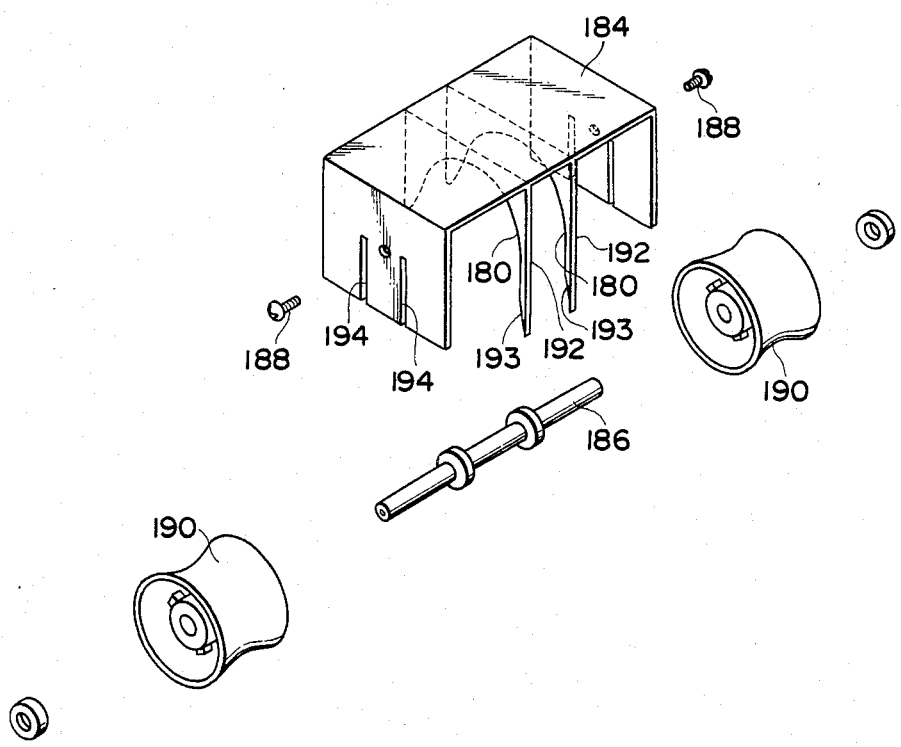
FIG. 11 is an exploded perspective view of a support bracket and rollers in combination constituting means for turning the leader.

As shown in FIG. 1, a support bracket 184 (also shown in FIG. 11) is secured to the respective upper ends of the adjacent units of a plurality of film conveyor units 100. The support bracket 184 is formed by bending a sheet material into a U-shape. A support shaft 186 is stretched between both leg portions of the bracket 184 and is secured thereto by screws 188. By this support shaft 186 are rotatably supported rollers 190 for turning the leader 46 which have the same configuration as that of the rollers 174 which are mounted at the respective lower portions of the film conveyor units 100.

Further, a pair of vertical walls 192 project from the center of the support bracket 184 at a proper spacing. Each vertical wall 192 has a circular guide portion 180 similar to that of each of the vertical walls 178 mounted in the respective lower portions of the film conveyor units 100. One of the ends of each vertical wall 192 forms a slanting guide portion 193. Moreover, the support bracket 184 has a pair of parallel slit-like notches 194 formed in each of the leg portions thereof such as to interpose the support shaft 186 therebetween.

Accordingly, when the support bracket 184 is installed in such a manner that the notches 194 are respectively engaged with the side plates 102 of the adjacent film conveyor units 100 as shown in FIG. 1, the rollers 190 are disposed between the respective upper portions of the adjacent film conveyor units 100. Thus, in the support bracket 184, the leader 46 is disengaged from the timing belt 124 and turned along the rollers 190 and is then transferred to the subsequent film conveyor unit 100 in a manner similar to that of the turning guide means mounted in the lower portion of each film conveyor unit 100. In - this case, therefore, the turning guide means formed in the support bracket 194 has the leader inlet and outlet which are respectively disposed on the extensions of the straight portions of the timing belts 124 respectively provided in the adjacent treating tanks. In particular, as shown in FIG. 5, the slanting guide portion 193 of each vertical wall 192 extends into the moving locus of the timing belt 124 such as to correspond to a position on the extension of the upwardly moving straight portion of the timing belt 124, thus allowing the leader 46 to be smoothly transferred to the circular guide portion 180.

Between the upper end of the treating tank 20 and the film feed device 36, a support bracket 196 is disposed which is arranged such as to guide the leader 46 and the films 38, which are being fed horizontally, to the film conveyor unit 100 disposed in the treating tank 20 and to allow the leader 46 to engage the timing belt 124. The structure of this support bracket 196 is similar to that of the support bracket 184. Therefore, in the support bracket 196 also, rollers 198 for turning the leader 46 are rotatably supported.

A support bracket 200 similar to the above-described support bracket 184 is mounted between the teating tanks 30 and 32. The support bracket 200 is arranged such as to move the leader 46 and the films 38 from the treating tank 30 to the treating tank 32 by turning the leader 46 and the films 38. However, the distance between the treating tanks 30 and 32 is slightly larger than that between the other adjacent treating tanks. For this reason, in the support bracket 200, a pair of rollers 202 for turning the leader 46 are rotatably supported in such a manner that they are a proper distance apart from each other as viewed from the side of the support bracket 200, as shown in FIG. 1.

In addition, the film conveyor units 100 respectively disposed in the treating tanks 26, 28, 30 and 32 are designed such as to be smaller in the longitudinal or vertical dimension than the film conveyor units 100 in the other treating tanks.

In the treating tank 32, a separator 206 having an inverted triangular shape is provided directly below the film conveyor unit 100 disposed therein. The arangement is such that the warm air from the heater 34 sent by the fan 35 is branched off by the separator 206 such as to be blown into the area between the vertical wall 33 and one of the cover plates 148 of the film conveyor unit 100 and into the area between the frame 14 and the other cover plate 148, and the warm air is blown out toward the films 38 through the through-holes 165 formed in the cover plates 148, thereby effecting a drying treatment.

Figure 12:
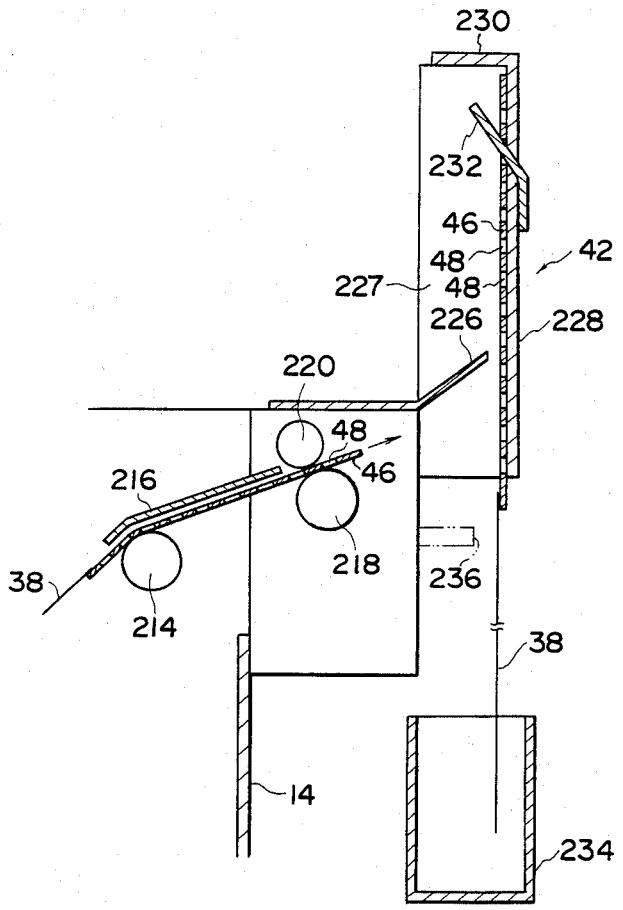
FIG. 12 is an enlarged sectional view of a film accumulating device employed in the embodiment.

The film accumulating device 42 is disposed adjacently to the treating tank 32. As shown in FIG. 12 in an enlarged manner, the film accumulating device 42 is provided with a guide roller 214 and a guide plate 216. The film accumulating device 42 is arranged such that the films 38, having been subjected to the developing process, are fed, together with the leader 46, into the area between the guide roller 214 and the guide plate 216.

The leader 46 and the films 38 guided by the guide plate 216 are fed into the area between a driving roller 218 and a guide roller 220, and the leader 46 fed out is further pulled out by the driving force of these rollers. A guide 226 is provided above the driving roller 218. The guide 226 extends obliquely upward. Accordingly, the leader 46 fed out from the area between the rollers 218, 220 is conveyed obliquely upward along the lower surface of the guide 226.

Adjacently to the rollers 218, 220, an accumulating plate 228 is connected to the frame 14 through a bracket 227. The accumulating plate 228 is disposed such that the longitudinal axis thereof extends vertically. The upper end of the plate 228 is bent such as to form a stopper 230, while the lower end of the plate 228 is open. Further, the accumulating plate 228 is provided at an intermediate portion thereof with a hook 232 which projects obliquely upward such that a multiplicity of leaders 46 can be suspended from the hook 232. Below the accumulating plate 228, a box 234 is placed for receiving the respective lower ends of the films 38.

The developing apparatus 12 in accordance with this embodiment arranged as described above operates as follows.

First of all, the respective leading ends of two films 38 are pulled out of the associated film cassettes 40 and are secured to the trailing end of the leader 46, as shown in FIG. 2. Then, the cover 56 shown in FIG. 3 is opened, and the film cassettes 40 are set on the holders 60. Further, the leader 46 is mounted on the conveyor roller 67.

When the operator closes the cover 56 in this state, the leader 46 is held between the conveyor rollers 66, 67, and a portion of each cutter 68 fits into the corresponding guide groove 86.

Then, the operator presses a predermined start button. Thereupon, the conveyor rollers 66, 67 are rotated, whereby the leader 46, together with the films 38, is conveyed in the direction of the arrow A in FIG. 3.

When the films 38 have been completely unwound off the respective spools 44 of the film cassettes 40, the holders 60 and the film cassettes 40 are moved toward the cutters 68 against the biasing force of the compression coil springs 64. For this purpose, it is necessary to set the biasing force of the compression coil springs 64 to be smaller than the film pulling force of the conveyor rollers 66, 67.

When the holders 60 have been moved forwardly by a predetermined distance, the front surfaces thereof press the contactors 88A of the limit switches 88. In consequence, the solenoids 82 are actuated such as to instantaneously move the actuating pins 80 upwardly, whereby the cutters 68 cut off the respective trailing ends of the films 38 from the film cassettes 40 (the spools 44, precisely speaking) as shown in FIG. 4.

Since each cutter 68 has partially entered the corresponding guide groove 86 beforehand and the guide groove 86 has an enlarged opening, as it is actuated, the cutter 68 is allowed to reliably pivot along the guide groove 86. After cutting the films 38, the cutters 68 are returned to their initial positions by the biasing forces of the torsion coil springs 76. The film cassettes 40 and the holder 60 are also pushed back to their initial positions by the biasing force of the compression coil spring 64.

The leader 46 is fed out from the area between the conveyor rollers 66, 67 and is downwardly turned by the support bracket 196 and the rollers 198 and is then engaged by the timing belt 124 in the treating tank 20. More specifically, the engagement projections 130 of the timing belt 124 respectively enter the square bores 48 in the leader 46, whereby the leader 46 is retained between the timing belt 124 and the guide bar 146 and is downwardly dipped into the treating solution contained in the treating tank 20.

In the vicinity of the lower end of this treating tank 20, the leader 46 is disengaged from the engagement projections 130 of the timing belt 124 as the timing belt 124 is turned. The leader 46 is then turned through the turning guide means formed by the rollers 174 and the bracket 176 and is moved upwardly. The leader 46 thus turned is re-engaged with the engagement projection 130 of the portion of the timing belt 124 moving upwardly and is moved toward the upper end of the treating tank 20.

The films 38, which are moved by being pulled by the leader 46 as it moves in this way, are prevented from meandering by the limiting blocks 162 and the pawls 156 which project from the inner surface of the cover plate 148 after the leader 46 has passed thereover. The films 38 are, therefore, properly developed in an appropriate tensile state and without contacting any other elements in the treating tank 20. In particular, the meandering prevention pawls are disposed such as to correspond to each of the opposing side edges of a pair of films 38 in order to limit the widthwise movement of the films 38, which fact allows reliable meandering prevention.

Moreover, each of the rollers 174 in the treating tank 20 has an outer peripheral configuration such that the outside diameter of the roller 174 is smallest at its axial center and is gradually increased toward both axial ends. Therefore, when the films 38 are turned by the bracket 176, they have an extremely small area of contact with the bracket 176. There is, therefore, no possibility that any undesirable flaw may be formed in the treated surfaces of the films 38.

The leader 46, which has been subjected to the developing treatment in the treating tank 20 and moved to the upper end thereof, is disengaged from the timing belt 124 again since the timing belt 124 is turned by the sprocket wheel 116. The leader 46 is then inserted into the turning guide means formed by the support bracket 184 and the rollers 190, whereby the leader 46 is turned such as to move downwardly and is transferred to the film conveyor unit 100 in the treating tank 22.

In this case also, the films 38 come in contact with the rollers 190 with an advantageously small area of contact; therefore, no flaw is formed.

Thereafter, by being led by the movement of the leader 46, the films 38 are successively subjected to bleaching, fixing, rinsing and stabilization through such operations as dipping, turning, takeout and transfer, which are effected in each of the treating tanks 22, 24, 26, 28, 30. The films 38 are then transferred to the treating tank 32, in which they are subjected to a drying treatment. The dried films 38 are delivered to the film accumulating device 210.

When the leader 46 attached to the respective leading ends of the films 38 has been fed out from the roller 214, the leader 46 is held by the driving roller 218 and the guide roller 220 as shown in FIG. 12.

Figure 13:
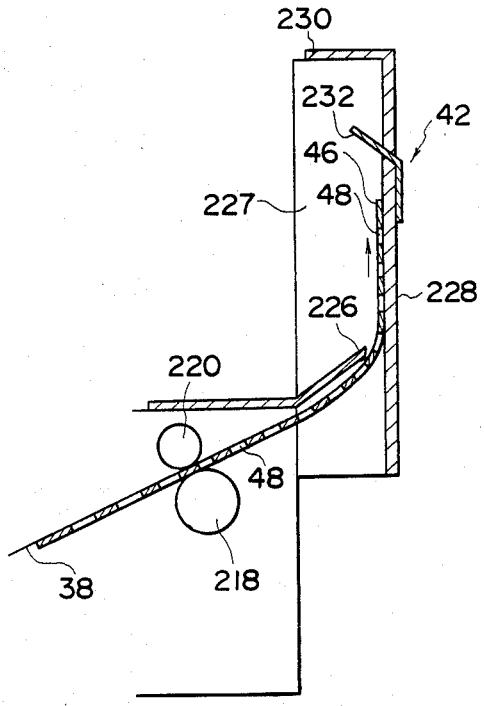
FIGS. 13 to 18 in combination show the operation of the film accumulating device shown in FIG. 12.

The leading end of the leader 46 advances along the lower surface of the guide 226 as shown in FIG. 13 and abuts against the inner surface of the accumulating plate 228 and is then turned upwardly. In the meantime, the trailing end of the leader 46 is still held between the driving roller 218 and the guide roller 220, and moreover, the leader 46 has flexibility. The leader 46 is, therefore, pushed up while abutting against the accumulating plate 228.

Figure 14:
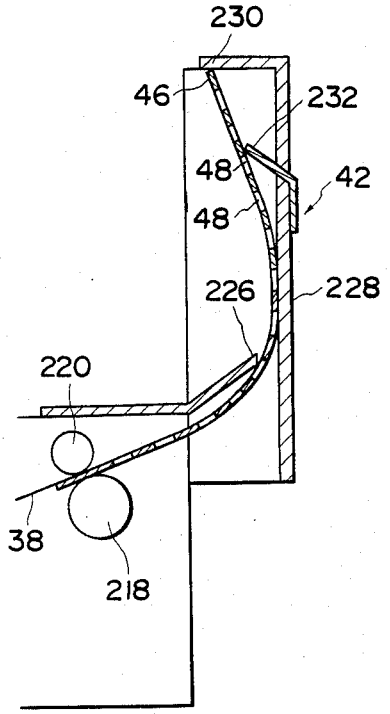

When the leading end of the leader 46 has reached the hook 232, as shown in FIG. 14, the leader 46 further advances upwardly while abutting against the distal end of the hook 232. The upward movement of the leader 46 is stopped when the leading end of the leader 46 abuts against the stopper 230. At this time, the trailing end of the leader 46 has already come out of the area between the driving roller 218 and the guide roller 220 and, therefore, the force for pushing up the leader 46 has almost disappeared.

Figure 15:
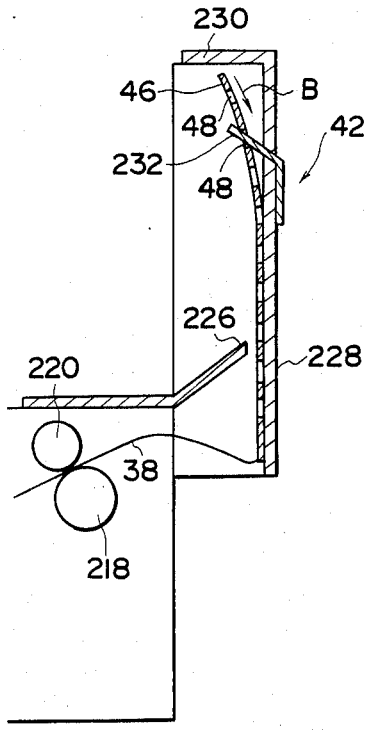

Accordingly, as the films 38 are further fed out from the area between the driving roller 218 and the guide roller 220, as shown in FIG. 15, the leader 46 moves in the direction of the arrow B by its own weight and restoring force. In consequence, one of the square bores 48 in the leader 46 engages the hook 232, and the leader 46 lowers until one side surface thereof comes in close contact with the inner surface of the accumulating plate 228.

Figure 16:
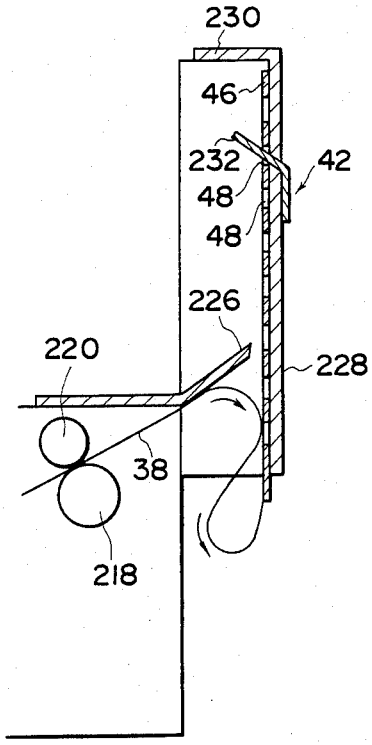
Figure 17:
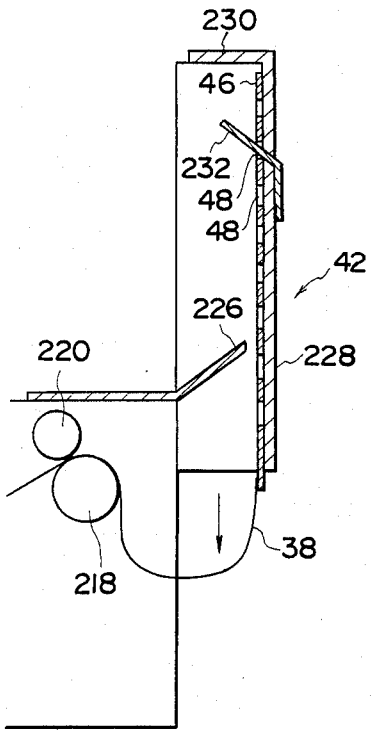
Figure 18:
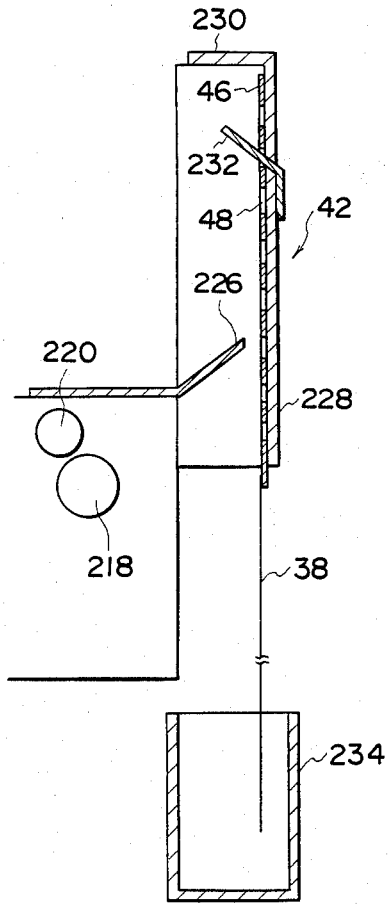
Figure 19:
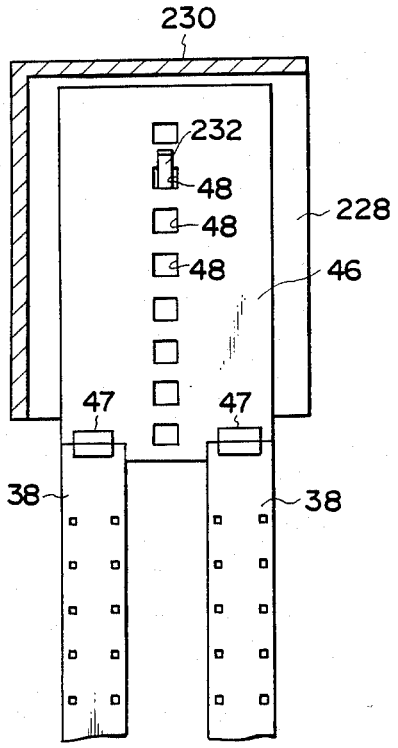
FIG. 19 is a front elevational view of the film accumulating device shown in FIG. 18.

On the other hand, the films 38 fed out from the area between the rollers 218, 220 are accumulated below the guide 226 while taking an inverted S shape as shown in FIG. 16. As the films 38 are further fed out, as shown in FIG. 17, the films 38 are momentarily turned downwardly by virtue of their flexibility and their own weight. When the respective trailing ends of the films 38 are fed out from the area between the rollers 218, 220, as shown in FIGS. 18 and 19, the leader 46 and the films 38 are suspended from the hook 232, and the respective trailing ends of the films 38 are deposited in the box 234.

It is to be noted that, if the leader 46 in the state shown in FIG. 14 is positioned such that a leading end portion thereof including two or more square bores 48 is located above the hook 232, then even if the first square bore 48 should fail to engage the hook 232, the subsequent square bore 48 will reliably engage the hook 232. Further, in the case where developed films which have been subjected to the drying step are charged with frictional electricity, as shown in FIG. 12, a static charge eliminator 236 is provided below the outlet 224, whereby any static charge can be eliminated from the developed films which are fed out successively.

A subsequent leader is retained by the hook 232 in the order corresponding exactly to that described above. In this manner, a multiplicity of films are accumulated by the film accumulating device 42 in an aligned state. When a predetermined number of leaders, together with films, have been collected on the hook 232, the operator removes them simultaneously.

It is to be noted that the present invention is not especially limitative in relation to the above-described structure in which the films 38 are inserted into and removed from each treating tank at the upper portion thereof and a structure may be employed in which the films 38 are inserted into a treating tank from one of the sides thereof and are taken out from the other side: For example, in a treating tank in which the sprocket wheels 116, 118 are respectively disposed at right and left positions therein and the timing belt 124 is disposed such that its longitudinal axis extends horizontally, the films 38 are inserted into the treating tank from either the right or left side thereof such as to be engaged with the timing belt 124 and are then taken out from the other side. In such case, accordingly, there is no need to turn the films 38 by the bracket 176.

It is to be noted also that, although, in the above-described embodiment, the connecting pins 132 are employed to connect together the timing projections of the timing belt 124 at the connection thereof, it is possible to employ connecting means other than the connecting pins 132, such as wedges, for coaxially connecting together the timing projections.

What is claimed is:

1. A developing apparatus which conducts a developing operation by conveying a film through a treating tank containing a developing solution, comprising:

(a) an endless timing belt at least one portion of which is immersed in said treating tank;

(b) sprocket wheels engaged with said timing belt such as to guide and drive the same;

(c) engagement projections formed on the outer periphery of said timing belt at a predetermined spacing from each other;

(d) a leader to which one of the ends of a film to be developed is attached and which has engagement bores engageable with said engagement projections, and is pulled by said timing belt so that said film is conveyed through said treating tank; and (e) guide means disposed such as to oppose the outer periphery of said timing belt and adapted to retain said leader between the same and said timing belt when said leader is driven through said engagement projections, thereby preventing disengagement of said engagement projections from said engagement bores in said leader.

2. A developing apparatus according to claim 1, further comprising means for turning around said leader disposed adjacently to the sprocket wheel which is disposed inside said treating tank to guide said timing belt in such a manner as to turn it around so that it faces upwardly, said means being arranged such that, when the portion of said timing belt at which said leader is engaged with said belt is turned by said wheel, said leader is temporarily disengaged from said engagement projections on the outer periphery of said timing belt, thereby coping with a change in pitch of said engagement projections.

3. A developing apparatus according to claim 2, wherein said leader turning means has a leader inlet on the extension of one of the straight portions of said timing belt and a leader outlet on the extension of the other straight portion, between which leader inlet and outlet is formed a turning guide portion for turning around said leader.

4. A developing apparatus according to claim 3, wherein said turning guide portion includes a roller engaged at its outer periphery with said leader or film, and a circular guide portion disposed in opposing relation to the outer periphery of said roller such as to guide said leader or film by its inner peripheral portion.

5. A developing apparatus according to claim 1, wherein said timing belt disposed in each of a plurality of treating tanks, and transfer means is disposed between the adjacent treating tanks to transfer said leader from one of the adjacent timing belts to the other.

6. A developing apparatus according to claim 5, wherein said transfer means is disposed adjacently to the sprocket wheel disposed in the upper portion of each of the adjacent treating tanks and has a leader inlet on the extension of the upward straight portion of said one timing belt and a leader outlet on the extension of the downward straight portion of said the other timing belt.

7. A developing apparatus according to claim 6, wherein said transfer means includes a roller for turning engaged at its outer periphery with said leader or film, and a circular guide portion disposed in opposing relation to the outer peiphery of said roller such as to guide said leader or film by its inner peripheral portion.

8. A developing apparatus according to claim 1, wherein said timing belt is constituted by a thin-walled belt base which has timing projections formed on one of the sides thereof at equal spacings and said engagement projections formed on the other side, said timing projections being employed for engagement with said sprocket wheels.

9. A developing apparatus according to claim 8, wherein said timing belt is designed such that both longitudinal ends of said belt base are fitted to each other with a lap which has a length equivalent to a portion of said belt which includes at least two of said timing projections, and the timing projections at one of the ends of said belt base and the timing projections at the other end are coaxially connected together by connecting means.

10. A developing apparatus according to claim 8, wherein said timing belt includes a plurality of small timing belts, each small timing belt being designed such that both longitudinal ends of the base thereof are fitted to each other with a lap which has a length equivalent to a portion of said small timing belt which includes at least two timing projections formed thereon, and the timing projections at one of the ends of the base of one small timing belt and the timing projections at one of the ends of the base of another small timing belt are coaxially connected together by connecting means.

11. A developing apparatus according to claim 10, wherein said connecting means are pins respectively received through the coaxially aligned timing projections.

12. A developing apparatus according to claim 1, wherein said guide means includes a guide bar disposed in opposing relation to a straight moving portion of said timing belt such as to retain said leader between the guide bar and said timing belt, said guide bar being formed with a groove for receiving said engagement projections of said timing belt, such as to serve as a passage for said engagement projections when said timing belt is moved.

13. A developing apparatus according to claim 1, wherein said guide means is provided on both sides thereof with limiting means which respectively oppose the side edges of said passing film such as to prevent meandering of said film.

14. A developing apparatus according to claim 13, wherein said limiting means are arranged such that they are biased such as to project into the passage of said leader and are able to withdraw from the passage of said leader in order to clear said passage when said leader passes thereover.

15. A developing apparatus according to claim 14, wherein each of said limiting means is provided with a slanting surface inclined with respect to the moving direction of said leader, said slanting surface abutting against said leader when it passes, whereby said limiting means is caused to be withdrawn from the passage of said leader.

16. A developing apparatus according to claim 8, further comprising a guide plate disposed inside the loop formed by said timing belt such as to oppose the respective inner peripheries of the straight portions of said timing belt, said guide plate being formed with grooves for allowing passage of said timing projections.

17. A developing apparatus according to claim 16, wherein said guide plate has notches respectively formed at longitudinal ends thereof, each notch receiving a part of the corresponding sprocket wheel.

18. A developing apparatus which conducts a developing operation by longitudinally conveying a film through various treating solutions, comprising:

(a) a plurality of treating tanks respectively containing said treating solutions;

(b) a plurality of endless timing belts at least one portion of each of which is immersed in the treating solution in the corresponding treating tank, each belt having engagement projections formed on one of the sides thereof at equal spacings;

(c) a plurality of sprocket wheels each engaged with the corresponding timing belt such as to rotate the same, each timing belt being disposed in a straight line between the associated wheels;

(d) a leader having engagement bores engageable with said engagement projections of each of said timing belts, said leader conveying said film through each of said treating tanks by the driving force of the associated timing belt while pulling one end of said film;

(e) guide means for preventing disengagement of said leader from each of said timing belts at a straight portion thereof; and (f) transfer means into which said leader moves as it comes out of one of said treating tanks and off the timing belt in that treating tank and which transfers said leader to the timing belt in a subsequent treating tank.

19. A developing apparatus according to claim 18, further comprising means for turning around said leader disposed adjacently to the sprocket wheel disposed inside said treating tank to guide said timing belt in such a manner as to turn it around so that it faces upwardly, said means being arranged such that, when the portion of said timing belt at which said leader is engaged with said belt is turned by said wheel, said leader is temporarily disengaged from said engagement projections on the outer periphery of said timing belt, thereby coping with a change in pitch of said engagement projections.

20. A developing apparatus according to claim 19, wherein said leader turning means has a leader inlet on the extension of one of the straight portions of said timing belt and a leader outlet on the extension of the other straight portion, between which leader inlet and outlet is formed a turning guide portion for turning around said leader.

21. A developing apparatus according to claim 20, wherein said turning guide portion includes a roller engaged at its outer periphery with said leader or film, and a circular guide portion disposed in opposing relation to the outer periphery of said roller such as to guide said leader or film by its inner peripheral portion.

22. A developing apparatus according to claim 18, wherein said transfer means is disposed adjacently to the sprocket wheel disposed in the upper portion of each of the adjacent treating tanks and has a leader inlet on the extension of the upward straight portion of said one timing belt and a leader outlet on the extension of the downward straight portion of said the other timing belt.

23. A developing apparatus according to claim 22, wherein said transfer means includes a roller for turning engaged at its outer periphery with said leader or film, and a circular guide portion disposed in opposing relation to the outer peiphery of said roller such as to guide said leader or film by its inner peripheral portion.

24. A developing apparatus according to claim 18, wherein said guide means includes a guide bar disposed in opposing relation to a straight moving portion of said timing belt such as to retain said leader between the guide bar and said timing belt, said guide bar being formed with a groove for receiving said engagement projections of said timing belt, such as to serve as a passage for said engagement projections when said timing belt is moved.

25. A developing apparatus according to claim 23, wherein said guide means is provided on both sides thereof with limiting means which respectively oppose the side edges of said passing film such as to prevent meandering of said film.

26. A developing apparatus according to claim 18, further comprising a guide plate disposed inside the loop formed by said timing belt such as to oppose the respective inner peripheries of the straight portions of said timing belt, said guide plate being formed with grooves for allowing passage of said timing projections.

27. A developing apparatus in which a film is longitudinally moved such as to be successively dipped in the treating solutions for development contained in respective treating tanks, comprising:

(a) a looped timing belt provided in each of said treating tanks, said belt having on its inner periphery timing projections and on its outer periphery engagement projections, these projections being formed at equal spacings;

(b) sprocket wheels engaged with said timing belt at at least two positions a predetermined distance apart from each other to guide said timing belt such that the portions of said timing belt between these wheels are straight and at least one portion of said belt is immersed in the treating solution contained in the corresponding treating tank;

(c) a leader retaining one end of the film to be treated and provided with bores engageable with said engagement projections of said timing belt;

(d) guide means respectively disposed such as to oppose the outer peripheral straight portions of said timing belt, with a space defined between said means and said timing belt, thereby allowing said leader to be conveyed by the driving force of said timing belt while retaining said leader between said guide means and said timing belt;

(e) transfer means disposed at the upper ends of a pair of treating tanks and having a leader inlet on the extension of the upwardly moving straight portion of the timing belt in the upstream side treating tank and a leader outlet on the extension of the downwardly moving straight portion of the timing belt in the downstream side treating tank so that said leader coming out of the upstream side treating tank is turned around by said transfer means and is transferred to the downstream side treating tank; and (f) a leader turning means provided at the turnaround point of the timing belt inside each treating tank and having a leader inlet on the extension of one of the straight portions of said timing belt and a leader outlet on the extension of the other straight portion so that said leader is disengaged from the one straight portion such as to be turned around by said turning means and is then fed to the other straight portion, whereby it is possible to cope with a change in pitch of said engagement projections at the portion of said timing belt at which it is engaged with said sprocket wheel.

28. A developing apparatus according to claim 27, wherein said leader turning means includes a roller engaged at its outer periphery with said leader or film, and a circular guide portion disposed in opposing relation to the outer periphery of said roller such as to guide said leader or film by its inner peripheral portion.

29. A developing apparatus according to claim 27, wherein said transfer means includes a roller for turning engaged at its outer periphery with said leader or film, and a circular guide portion disposed in opposing relation to the outer peiphery of said roller such as to guide said leader or film by its inner peripheral portion.

30. A developing apparatus according to claim 27, wherein said timing belt is designed such that both longitudinal ends of said belt base are fitted to each other with a lap which has a length equivalent to a portion of said belt which includes at least two of said timing projections, and the timing projections at one of the ends of said belt base and the timing projections at the other end are coaxially connected together by connecting means.

31. A developing apparatus according to claim 27, wherein said timing belt includes a plurality of small timing belts, each small timing belt being designed such that both longitudinal ends of the base thereof are fitted to each other with a lap which has a length equivalent to a portion of said small timing belt which includes at least two timing projections formed thereon, and the timing projections at one of the ends of the base of one small timing belt and the timing projections at one of the ends of the base of another small timing belt are coaxially connected together by connecting means.

32. A developing apparatus according to claim 27, wherein said guide means includes a guide bar disposed in opposing relation to a straight moving portion of said timing belt such as to retain said leader between the guide bar and said timing belt, said guide bar being formed with a groove for receiving said engagement projections of said timing belt, such as to serve as a passage for said engagement projections when said timing belt is moved.

33. A developing apparatus according to claim 32, wherein said guide means is provided on both sides thereof with limiting means which respectively oppose the side edges of said passing film such as to prevent meandering of said film.

* * * * *